US011939760B2

(12) United States Patent
Hawn et al.

(10) Patent No.: US 11,939,760 B2
(45) Date of Patent: Mar. 26, 2024

(54) VACUUM SEWAGE SYSTEM WITH MONITORING SYSTEM AND VARIABLE SPEED PUMP AND METHODS OF USE

(71) Applicant: Aqseptence Group, Inc., Rochester, IN (US)

(72) Inventors: Clint Hawn, Warsaw, IN (US); Jon R Hartsock, Tippecanoe, IN (US)

( * ) Notice: Subject to any disclaimer, the term of this patent is extended or adjusted under 35 U.S.C. 154(b) by 761 days.

(21) Appl. No.: 16/833,847

(22) Filed: Mar. 30, 2020

(65) Prior Publication Data

US 2021/0301516 A1 Sep. 30, 2021

(51) Int. Cl.
*E03F 1/00* (2006.01)
*E03F 5/10* (2006.01)
*E03F 7/04* (2006.01)

(52) U.S. Cl.
CPC ..... *E03F 1/006* (2013.01); *E03F 5/107* (2013.01); *E03F 7/04* (2013.01); *Y10T 137/0324* (2015.04)

(58) Field of Classification Search
CPC ... E03F 7/04; E03F 5/107; E03F 1/006; E03F 5/22; E03F 2201/20; E03F 2201/30; E03F 2201/40; Y10T 137/0324; Y10T 137/0396
USPC ..... 137/236, 209, 1, 12, 14; 406/22, 48, 93, 406/14, 15, 18, 19, 50
See application file for complete search history.

(56) References Cited

U.S. PATENT DOCUMENTS 2,880,745 A * 4/1959 Regan ..... B65G 53/30 406/48
4,155,851 A 5/1979 Michael
4,179,371 A 12/1979 Foreman et al.
4,184,506 A * 1/1980 Varis ..... E03F 1/006 417/144
4,275,470 A * 6/1981 Badger ..... B64D 11/02 251/5
4,691,731 A * 9/1987 Grooms ..... E03F 1/006 137/236.1

(Continued)

FOREIGN PATENT DOCUMENTS

DE 2637962 A1 3/1978
DE 3520538 A1 12/1986

(Continued)

OTHER PUBLICATIONS

European Patent Office, International Search Report issued in PCT/US2020/025868, dated Nov. 24, 2020, 6 pages.

(Continued)

*Primary Examiner* — Craig J Price

(57) ABSTRACT

A vacuum sewage system includes a collection station, a variable speed vacuum pump, a variable speed drive, a control system, a sewage pump, a collection tank, a valve pit, a first conduit extending from the collection station to the valve pit, a second conduit extending from the valve pit and terminating in a closed end, a sensor located adjacent the closed end of the second conduit, and a valve located in the valve pit for selectively permitting sewage and waste water to flow from the valve pit toward the collection station upon activation of the valve. The control system, variable speed drive and sensor may be utilized to adjust the vacuum level and vacuum level range at the collection station so as to reduce the speed and operation time of the variable speed vacuum pump while maintaining the desired vacuum level in the vacuum sewage system.

17 Claims, 6 Drawing Sheets

(56) References Cited

U.S. PATENT DOCUMENTS

| | | | | |
|---|---|---|---|---|
| 5,044,836 | A | 9/1991 | Grooms | |
| 5,064,314 | A | 11/1991 | Grooms et al. | |
| 5,083,885 | A | 1/1992 | Ushitora et al. | |
| 5,487,646 | A | 1/1996 | Ushitora et al. | |
| 5,575,304 | A * | 11/1996 | Hassett | E03F 1/008 137/236.1 |
| 6,206,646 | B1 | 3/2001 | Bucher | |
| 9,541,088 | B2 | 1/2017 | Kawamura et al. | |
| 9,828,757 | B2 * | 11/2017 | Boren | E03F 1/007 |
| 10,316,504 | B2 * | 6/2019 | Jones | E03F 1/007 |
| 10,365,668 | B2 * | 7/2019 | Swan | G05D 7/0676 |
| 10,584,473 | B2 * | 3/2020 | Crosby | E03F 5/22 |
| 10,655,317 | B2 * | 5/2020 | Lappalainen | E03F 1/006 |
| 11,391,031 | B2 * | 7/2022 | Lappalainen | E03F 1/00 |
| 2005/0016588 | A1 * | 1/2005 | Shimizu | F04F 1/02 137/205 |
| 2010/0065131 | A1 * | 3/2010 | Grooms | E03F 1/007 137/205 |
| 2011/0180161 | A1 | 7/2011 | Boren | |
| 2011/0192465 | A1 | 8/2011 | Collings, III | |
| 2011/0214758 | A1 * | 9/2011 | Spitzer | E03F 1/006 137/511 |
| 2015/0346734 | A1 | 12/2015 | Blocher et al. | |

FOREIGN PATENT DOCUMENTS

| | | | |
|---|---|---|---|
| DE | 10159835 | A1 | 6/2003 |
| EP | 0415360 | A2 | 3/1991 |
| EP | 0431460 | A1 | 6/1991 |
| EP | 0943805 | A1 | 9/1999 |
| GB | 2017188 | A | 10/1979 |
| WO | 2017023421 | A1 | 2/2017 |

OTHER PUBLICATIONS

European Patent Office, Written Opinion issued in PCT/US2020/025868, dated Nov. 24, 2020, 8 pages.

European Patent Office, International Search Report issued in PCT/US2016/036791, dated Nov. 14, 2016, 8 pages.

European Patent Office, Written Opinion issued in PCT/US2016/036791, dated Nov. 22, 2016, 14 pages.

* cited by examiner

VACUUM SEWAGE SYSTEM WITH MONITORING SYSTEM AND VARIABLE SPEED PUMP AND METHODS OF USE

The present invention relates generally to sewage systems which utilize differential pressures to produce sewage transport through the system and, in particular, to such a sewage system having at least one variable speed vacuum pump and a monitoring system for determining the conditions prevailing at various locations in the system. The present invention also relates to methods for using such a system.

SUMMARY OF THE INVENTION

In one embodiment of the present invention, a method of operating a vacuum sewage system includes the steps of specifying a vacuum level operating range at a collection station, specifying a vacuum level at a location in the system, detecting the vacuum level at the collection station, utilizing a sensor to detect the vacuum level at the location in the system, comparing the vacuum level detected at the location in the system with the previously specified vacuum level for that location, and if the vacuum level detected at the location in the system is equal to or greater than the previously specified vacuum level for that location and the vacuum level detected at the collection station is within the previously specified vacuum level operating range for the collection station, reducing the vacuum level operating range for the collection station.

In one embodiment, the method further includes the steps of detecting the vacuum level at the collection station after reducing the vacuum level operating range for the collection station, detecting the vacuum level at the location in the system after reducing the vacuum level operating range for the collection station, comparing the newly detected vacuum level at the location in the system with the previously specified vacuum level for that location, and if the newly detected vacuum level at the location in the system is equal to or greater than the previously specified vacuum level for that location and the newly detected vacuum level at the collection station is within the reduced vacuum level operating range for the collection station, further reducing the vacuum level operating range for the collection station.

In one embodiment, the specified vacuum level at a location in the system is 12 inches of mercury.

In another embodiment, the specified vacuum level operating range at the collection station is 18 to 20 inches of mercury. In certain embodiments, the specified vacuum level operating range at the collection station is 16 to 18 inches of mercury.

In other embodiments, the vacuum sewage system includes a conduit having a first end and a second end. The second end of the conduit is located farther from the collection station than the first end of the conduit and the sensor detects the vacuum level at the second end of the conduit.

In another embodiment, the method includes the step of setting the lower end of the reduced vacuum level operating range for the collection station to a point below the lower end of the originally specified vacuum level operating range for the collection station.

In one embodiment, the vacuum sewage system includes a variable speed vacuum pump and the method further includes the step of reducing the speed of the variable speed vacuum pump after reducing the vacuum level operating range for the collection station.

In yet another embodiment, the vacuum sewage system includes a variable speed vacuum pump and the method further includes the step of reducing the operating time of the variable speed vacuum pump after reducing the vacuum level operating range for the collection station.

In one embodiment of the present invention, a method of operating a vacuum sewage system includes the steps of specifying a vacuum level operating range at a collection station, specifying a vacuum level at a location in the system, detecting the vacuum level at the collection station, utilizing a sensor to detect the vacuum level at the location in the system, comparing the vacuum level detected at the location in the system with the previously specified vacuum level for that location, and if the vacuum level detected at the location in the system is equal to or greater than the previously specified vacuum level for that location and the vacuum level detected at the collection station is within the previously specified vacuum level operating range for the collection station, specifying a new vacuum level operating range for the collection station equal in magnitude to the originally specified vacuum level operating range for the collection station and having a lower upper limit.

In one embodiment, the method further includes the steps of detecting the vacuum level at the collection station after specifying the new vacuum level operating range for the collection station, detecting the vacuum level at the location in the system after specifying the new vacuum level operating range for the collection station, comparing the newly detected vacuum level at the location in the system with the previously specified vacuum level for that location, and if the newly detected vacuum level at the location in the system is equal to or greater than the previously specified vacuum level for that location and the newly detected vacuum level at the collection station is within the newly specified vacuum level operating range for the collection station, specifying a second new vacuum level operating range for the collection station equal in magnitude to the originally specified vacuum level operating range for the collection station and having a lower upper limit than the first newly specified vacuum level operating range for the collection station.

In one embodiment, the specified vacuum level at a location in the system is 12 inches of mercury.

In another embodiment, the specified vacuum level operating range at the collection station is 18 to 20 inches of mercury. In certain embodiments, the newly specified vacuum level operating range at the collection station is 16 to 18 inches of mercury.

In other embodiments, the vacuum sewage system includes a conduit having a first end and a second end. The second end is located farther from the collection station than the first end and the sensor detects the vacuum level at the second end of the conduit.

In certain embodiments, the vacuum sewage system includes a variable speed vacuum pump and the method further includes the step of reducing the speed of the variable speed vacuum pump after specifying the new vacuum level operating range for the collection station.

In one embodiment, the vacuum sewage system includes a variable speed vacuum pump and the method further includes the step of reducing the operating time of the variable speed vacuum pump after specifying the new vacuum level operating range for the collection station.

In one embodiment of the present invention, a vacuum sewage system includes a valve pit, a collection station, a first conduit extending from the collection station to the valve pit, a second conduit extending from the valve pit and terminating in a closed end, a valve located in the valve pit for selectively permitting sewage and waste water to flow from the valve pit toward the collection station upon activation of the valve, a sensor located adjacent the closed end of the second conduit, a sewage pump located at the collection station, a collection tank located at the collection station, a variable speed vacuum pump located at the collection station, a variable speed drive, and a control system. The variable speed vacuum pump is connected to the collection station by at least one section of piping and is configured to draw a vacuum on the collection tank, the first conduit and the second conduit. The variable speed drive is configured to selectively increase and decrease the speed at which the variable speed vacuum pump operates. The control system is configured to control operation of the variable speed drive.

In one embodiment, the control system includes a programmable controller. In another embodiment, the control system includes means for communicating with the sensor. In certain embodiments, the means for communicating with the sensor includes wireless communication means.

These and other features of the present invention will become apparent to those skilled in the art upon review of the following description and accompanying drawings.

DETAILED DESCRIPTION OF THE EMBODIMENTS OF THE INVENTION

Figure 1:
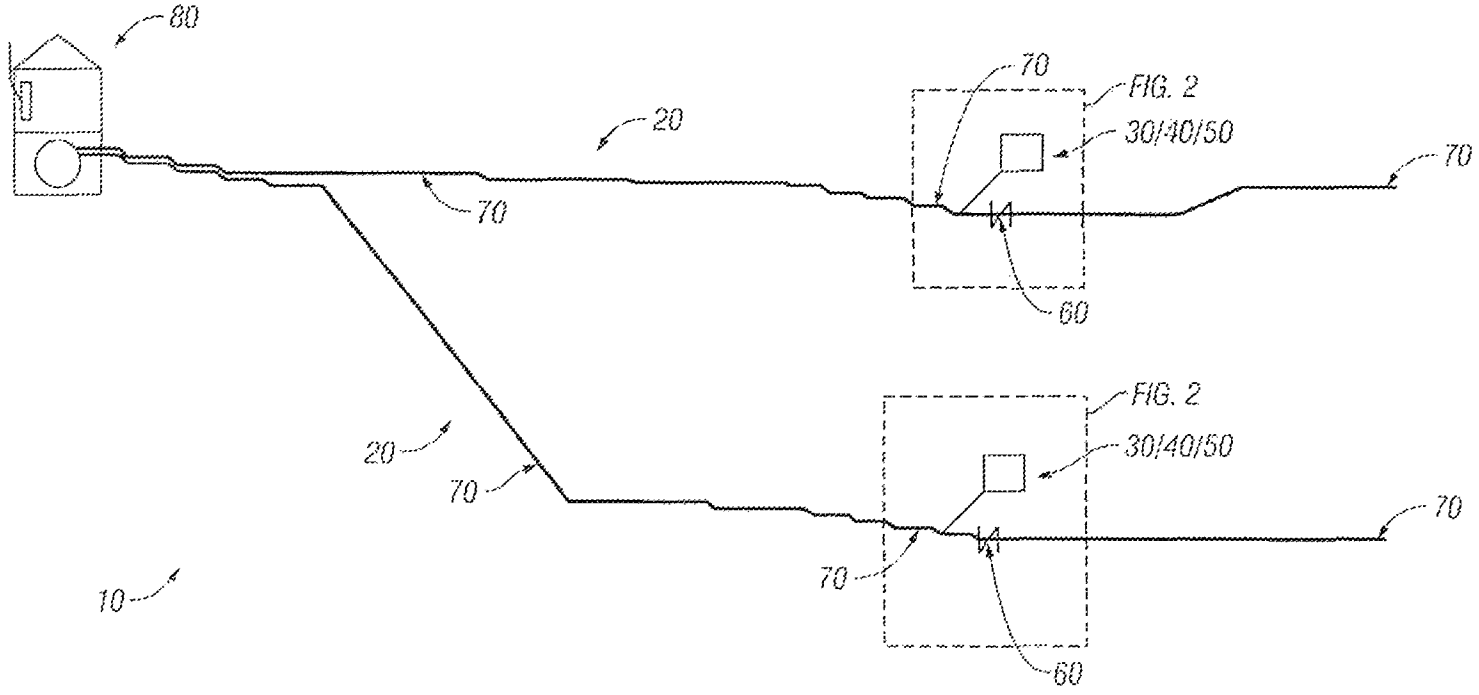
PRIOR ART FIG. 1
FIG. 1 is a schematic view of a vacuum sewage system according to one embodiment of the present invention.
Figure 2:
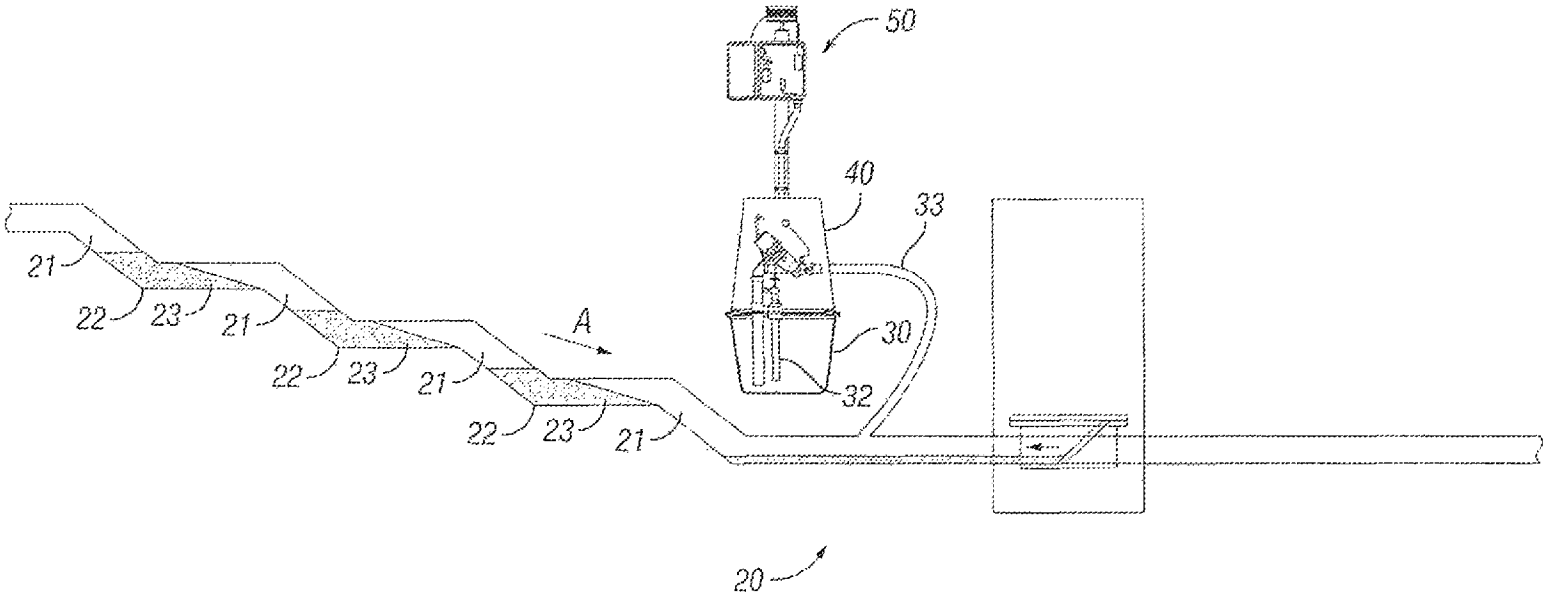
FIG. 2 PRIOR ART
FIG. 2 is a detail view of the areas indicated in FIG. 1 by reference "FIG. 2."

FIGS. 1 and 2 illustrate a vacuum sewage system 10 according to one embodiment of the present invention. System 10 generally includes a series of conduits 20, holding tanks 30, valve pits 40, electric air admission controllers ("EAAC") 50, check valves 60, sensors 70 and a collection station 80.

Conduits 20 are typically laid out in a saw-toothed pattern with a repeating series of risers 21, low points 22, and downslopes 23 (each series collectively called a "lift"). In certain prior art systems, the downslopes are inclined at an angle of 0.2%. In one embodiment of the present invention, downslopes 23 are inclined in the direction of arrow "A" at an angle of 0.1%. Laser leveling and surveying technology may be used to accurately position downslopes 23. Reducing the angle of incline of downslopes 23 can reduce the number of lifts required in system 10 (in some applications reducing the number of lifts by 50%) which permits larger networks of conduit 20. The 0.1% downslope angle also reduces vacuum loss throughout system 10. Locating check valves 60 behind the various lifts in conduits 20 prevents backflow through system 10. The use of check valves 60 positioned in this manner may be particularly beneficial when used in connection with the 0.1% angle downslopes 23 of conduits 20.

Figure 3:
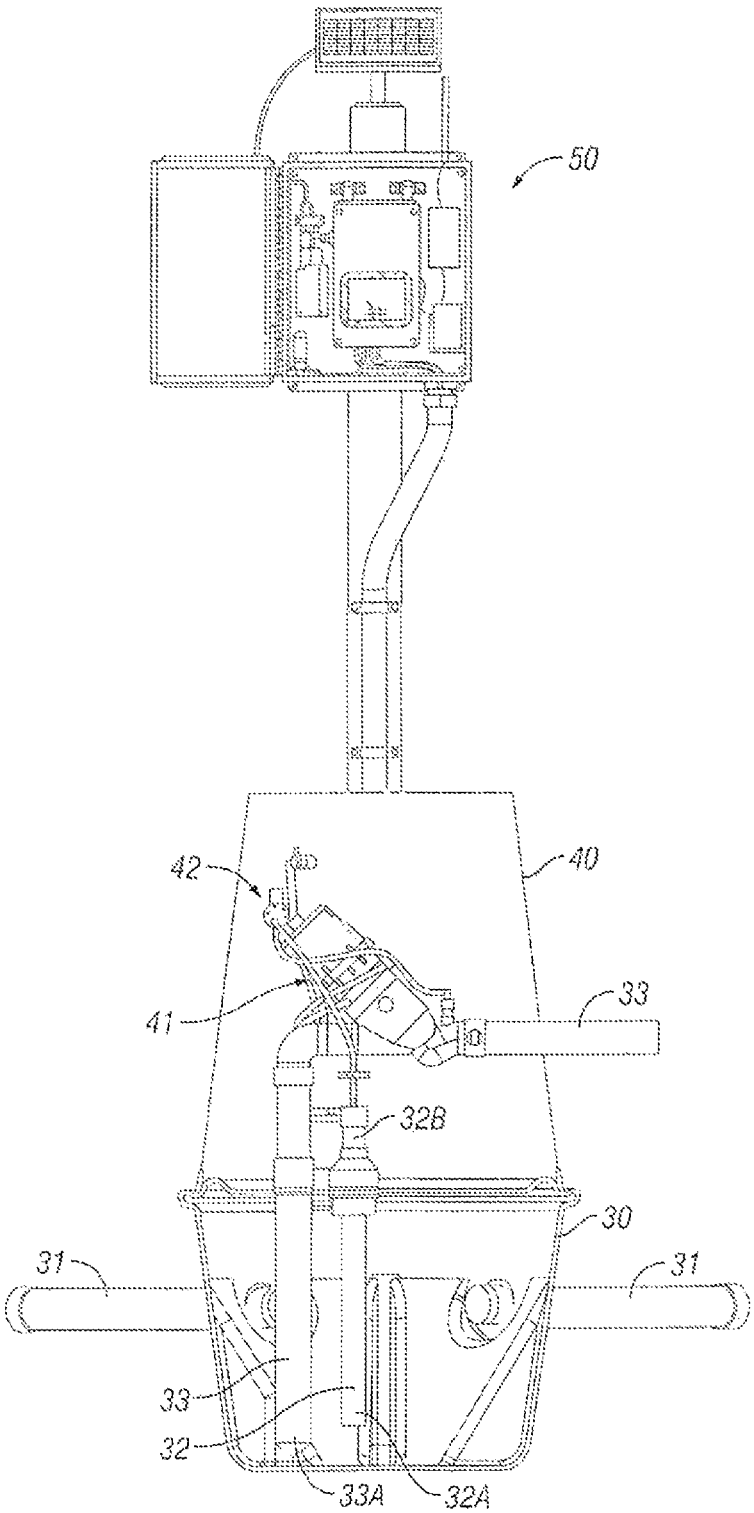
FIG. 3 PRIOR ART
FIG. 3 is a partial sectional view of a valve pit and electric air admission controller that are components of the system of FIG. 1.
Figure 4:
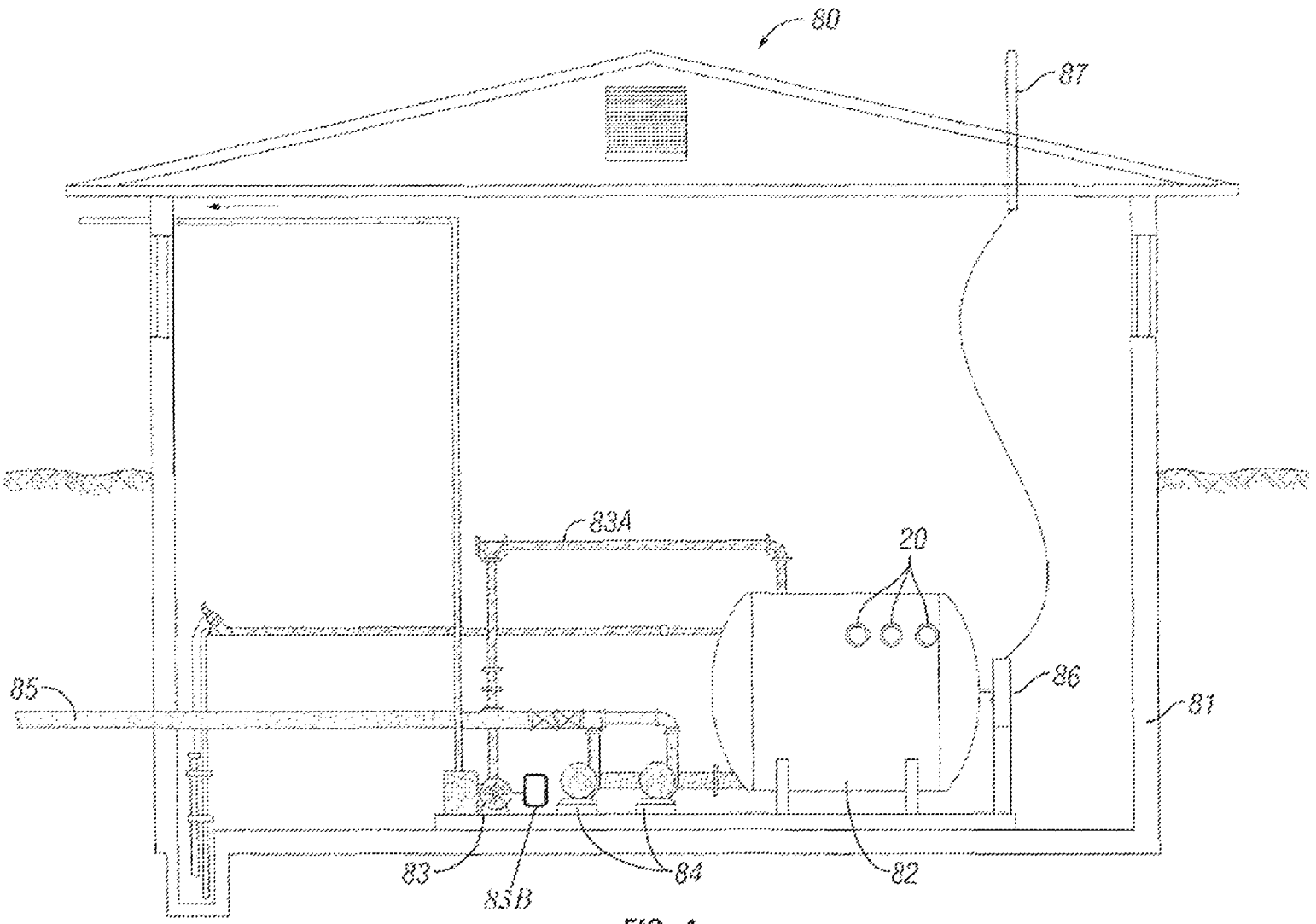
FIG. 4 is an elevational view of a collection station that is a component of the system of FIG. 1.
Figure 5:
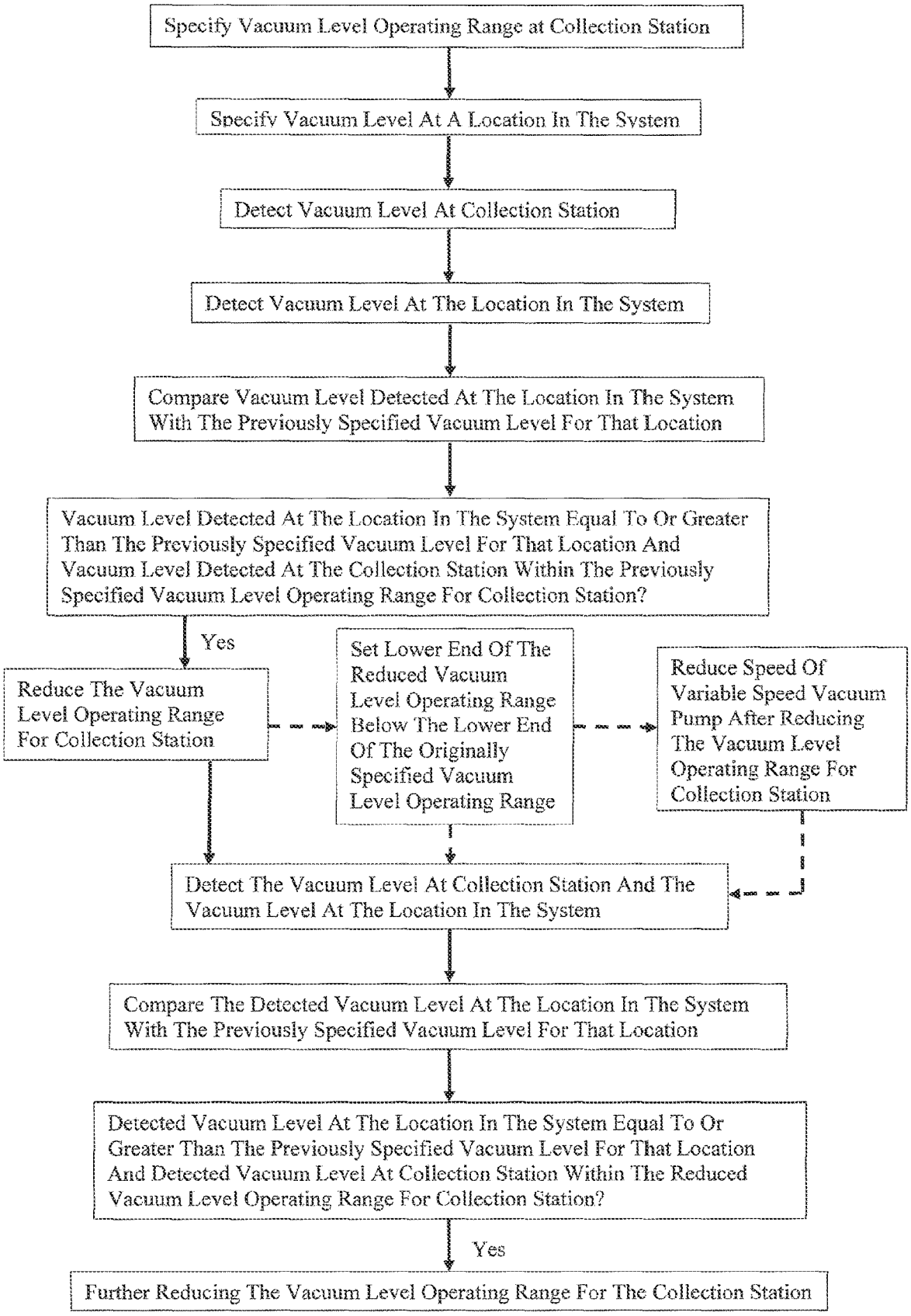
FIG. 5 is a flow chart illustrating methods of operating a vacuum sewage system according to embodiments of the present invention.
Figure 6:
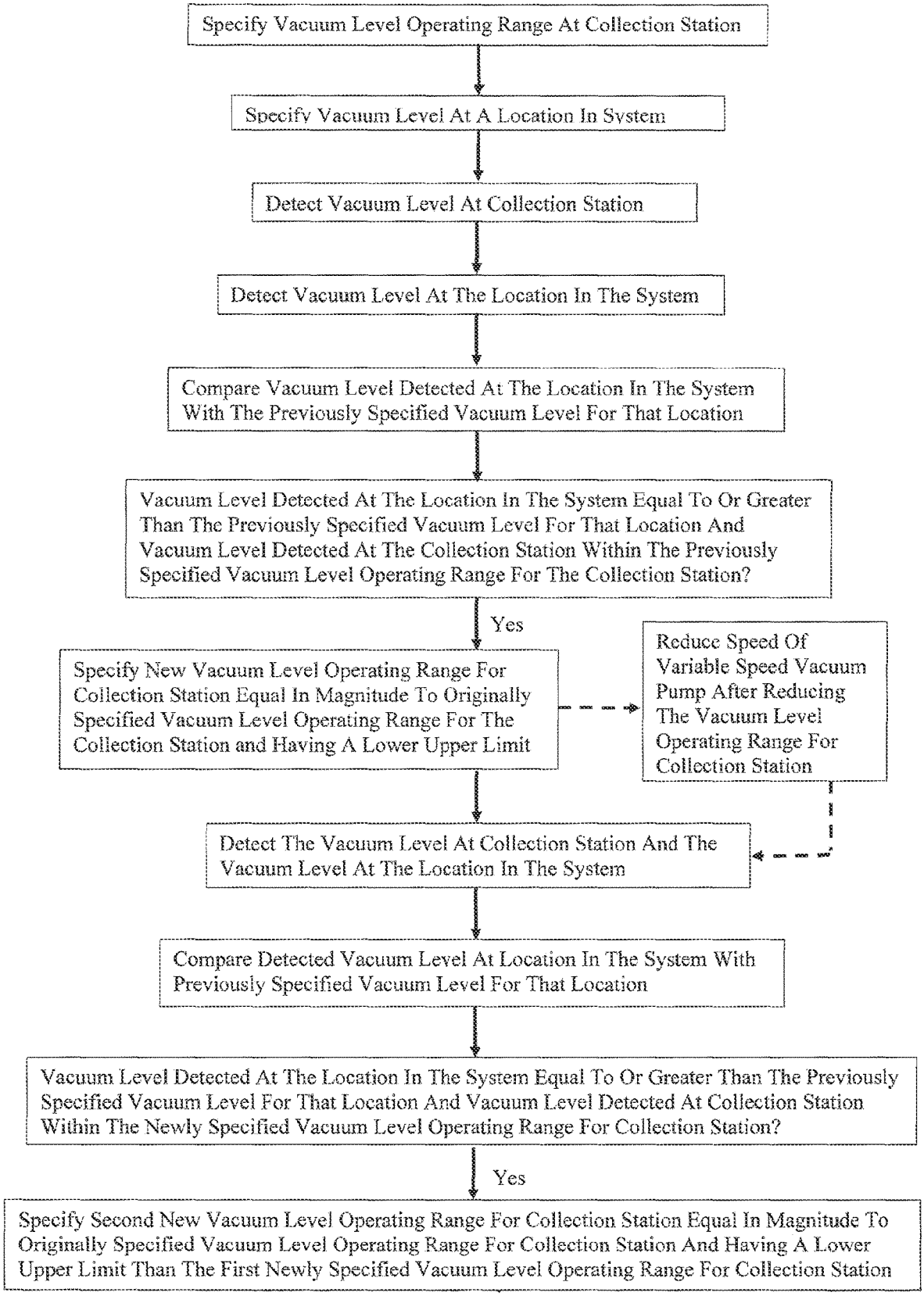
FIG. 6 is a flow chart illustrating methods of operating a vacuum sewage system according to other embodiments of the present invention.

Referring to FIGS. 2 and 3, conduits 31 transport sewage to holding tank 30, which is maintained at atmospheric pressure. A sensor pipe 32 and a discharge conduit 33 extend into tank 30. A first end 32A of pipe 32 extends downwardly into tank 30 to a point spaced above the inlet opening 33A of a discharge conduit 33. The second end 32B of pipe 32 extends into a valve pit 40. Discharge conduit 33 extends into the valve pit 40 to a valve 41. Numerous types of valves 41 are known in the industry. One example of a valve 41 that can be used with system 10 is disclosed in U.S. Pat. No. 4,171,853. Valve 41 is operated by a controller 42. The section of discharge conduit 33 downstream from valve 41 is maintained at vacuum or low pressure by one or more vacuum pumps (described below). Discharge conduit 33 ultimately discharges into collection station 80, which is also maintained at vacuum or low pressure.

In use, sewage is discharged through conduit 31 into tank 30. Under preselected pressure conditions in tank 30 (i.e. when the sewage content of tank 30 is such that a discharge cycle is warranted) valve 41 is opened by controller 42. Opening valve 41 creates a differential pressure between the relatively low pressure or vacuum portion of discharge conduit 33 downstream from valve 41 and the relatively higher or atmospheric pressure portion of discharge conduit 33 upstream from valve 41. This pressure differential causes discharge of the sewage in tank 30 through inlet opening 33A of discharge conduit 33, past valve 41, through the portion of discharge conduit 33 downstream from valve 41 and ultimately to collection station 80.

Collection station 80 generally includes a shed or other enclosure 81, a collection tank 82, one or more vacuum pumps 83, one or more sewage pumps 84, sewage discharge conduit 85 and a control system 86 which, in the embodiment shown, includes a programmable controller including wireless communication means, and a wireless communication antenna 87. Conduits 20 discharge into collection tank 82. Vacuum pump 83 is connected to piping 83A. In embodiments of the present invention, vacuum pump 83 is a variable speed vacuum pump that is driven by a variable speed drive 83B. Variable speed drive 838 can be incorporated into vacuum pump 83, can be a separate component, or can be incorporated into control system 86. As explained in greater detail below, variable speed drive 83B increases and decreases the operating speed of vacuum pump 83 depending on the conditions prevailing in system 10. Vacuum pump 83 draws a vacuum on collection tank 82 and through conduits 20 of system 10. Sewage pumps 84 discharge sewage from collection tank 82 through discharge pipe 85 to a sewage treatment facility (not shown.) Control system 86 and antenna 87 communicate with sensors 70 as described below.

Upon completion of a transport cycle, valve 41 is automatically closed and the vacuum sewage transport system of the invention is restored to the stand-by condition. With the saw-toothed arrangement of conduits 20 discussed above, sewage that was not transported to collection station 80 will generally come to rest in the low points 22 and will not seal the conduit 20 when the transport cycle ends. This permits the same vacuum pressure to be distributed throughout the conduits 20, including that portion of the conduit above the material in the low portion 22 of the conduit.

EAAC's 50 are an optional component of vacuum sewage system 10 according to certain embodiments of the present invention. However, EAAC's can be useful for addressing certain conditions that can occur in system 10, such as waterlogging. Waterlogging occurs when residual waste matter in conduit 20 accumulates to the point that fills all or a significant portion of the conduit cross section (such as two-thirds or more) as shown in FIG. 2. This prevents the vacuum pressure produced by vacuum pump 83 from being communicated through the entire network of conduits 20. EAAC's, such as those described in U.S. Pat. No. 5,044,836, may be used to monitor the vacuum level at the location of the EAAC. If the localized vacuum level drops, due to factors such as waterlogging, the EAAC can activate a valve 41 and admit additional air into system 10, thereby clearing the waterlogged condition.

Sensors 70 are used to monitor the vacuum level in system 10. For example, sensors 70 can be located at the ends of conduits 20 and elsewhere in system 10 to monitor the vacuum levels at desired locations in system 10. In one embodiment of the invention, sensors 70 are pressure transducers that measure the vacuum level and convert it to a voltage scaled to the vacuum level. Other types of sensors may be used in addition to or instead of pressure transducers. Sensors 70 include wireless communication technology for transmitting vacuum-level readings to control system 86. In this manner, the conditions in system 10 can be monitored.

Certain prior art vacuum sewage systems utilize one or more single speed vacuum pumps and are designed such that the vacuum level at the collection station is maintained between 16 inches of mercury and 20 inches of mercury. Maintaining the vacuum level at the collection station within this range has been found to produce a desired vacuum level at the end of the conduits of, for example, at least 12 inches of mercury. In these systems, one or more of the single speed vacuum pumps may be operated when the vacuum level at the collection station drops to 16 inches of mercury or below. Similarly, one or more of the single speed vacuum pumps in these systems may be operated when the vacuum level at the end of the conduit drops to 12 inches of mercury or below.

As noted above, vacuum sewage system 10 according to embodiments of the present invention utilize one or more variable speed vacuum pumps 83 driven by one or more variable speed drives 83B. Unlike single seed vacuum pumps, which have to reach a minimum operational speed to draw a vacuum and constantly operate at that speed, variable speed vacuum pumps 83 of the present invention draw a vacuum over a range operational speeds. Variable speed vacuum pumps 83 utilized in vacuum sewage systems 10 of the present invention can therefore be operated at lower speeds than the single speed vacuum pumps of the prior art. This results in both lower energy costs and lower noise levels.

Using variable speed vacuum pumps 83 also permits system 10 of the present invention to operate over a more narrow vacuum range at collection station 80 with greater efficiency than prior art systems that use single speed vacuum pumps. Because a single speed vacuum pump must reach a minimum speed to draw a vacuum and operates only at that speed, (a) there can be significant lag time between when the pump is started and when it reaches the operating speed necessary to draw a vacuum, (b) a certain amount of energy input is required to bring the pump up to speed even though it is not drawing vacuum on the sewage system, and (c) the single speed pump continues to consume the energy required to maintain the minimum pump speed as the level of vacuum rises. Thus, systems that utilize single speed pumps cannot respond as quickly to changes in vacuum level within the system and waste energy coming up to speed and maintaining a higher speed than may actually be necessary to draw the desired level of vacuum on the sewage system. In order to compensate for this lack of responsiveness, reduce the number of times that a single speed pump cycles on and off, and reduce the run time of the single speed vacuum pump, prior art systems maintain the vacuum level at the collection station over a broader range than what is likely to be required during typical operating conditions. For example, if a vacuum level of approximately 16 inches of mercury at the collection station is typically required to maintain the desired vacuum level throughout a particular vacuum sewage system, certain prior art vacuum sewage systems maintain the vacuum at the collection station in the range of 16 to 20 inches of mercury. This reduces the need to cycle the single speed vacuum pump on and off as frequently and reduces the run time of the single speed vacuum pump.

The same principles apply with respect to the vacuum level at the ends of the conduits. If the desired vacuum level at the ends of the conduits is at least 12 inches of mercury, certain prior art systems may be operated until the vacuum level reaches 14 inches of mercury to compensate for the lag time inherent in the single speed vacuum pumps of prior art systems and to reduce operation of the single speed pump.

In contrast, vacuum sewage system 10 of the present invention can operate collection station 80 in a narrower vacuum level range and can increase and decrease the range as needed because variable speed vacuum pumps 83 (*a*) do not have the lag time issues associated with single speed vacuum pumps and (b) can be cycled on and off more frequently and/or run for longer periods of time without increasing energy consumption because they can be operated at lower speeds than single speed vacuum pumps when conditions in vacuum sewage system 10 permit. For example, control system 86 can be utilized to set an operating range for the vacuum level at collection station 80 of 18 to 20 inches of mercury and a minimum vacuum level at the ends of conduits 20 of at least 12 inches of mercury. Sensors 70 communicate the vacuum level at the ends of conduits 20 to control system 86. If sensors 70 indicate that the vacuum level at the ends of conduits 20 is greater than or equal to 12 inches of mercury while the vacuum level at collection station 80 is between 18 and 20 inches of mercury, control system 86 can reduce the operating range to, for example, 18 to 19 inches of mercury. Control system 86 and variable speed drive 83B can be utilized to reduce the speed and/or operating time of variable speed vacuum pump 83 to only that level needed to maintain the vacuum level at collection station 80 within this smaller range. Sensors 70, control system 86, and variable speed drive 838 can be utilized to continually monitor the vacuum level at the ends of conduits 20 and to shrink or expand the vacuum level range at collection station 80 (as well as to increase or decrease the operating speed and/or time of variable speed vacuum pump 83) to as small a range as possible while still maintaining a vacuum level of at least 12 inches of mercury at the ends of conduits 20. Operating variable speed vacuum pump 83 at lower speeds and/or for less time reduces the energy consumption of vacuum sewage systems 10 according to the present invention as compared to prior art systems that utilize single speed vacuum pumps.

Use of variable speed vacuum pumps 83 also permits the operating range at collection station 80 to be shifted up or down. For example, control system 86 can be utilized to set an operating range for the vacuum level at collection station 80 of 18 to 20 inches of mercury and a minimum vacuum level at the ends of conduits 20 of at least 12 inches of mercury. Sensors 70 communicate the vacuum level at the ends of conduits 20 to control system 86. If sensors 70 indicate that the vacuum level at the ends of conduits 20 is greater than or equal to 12 inches of mercury while the vacuum level at collection station 80 is between 18 and 20 inches of mercury, control system 86 can lower the target vacuum range at collection station 80 to, for example, 16 to 18 inches of mercury. Control system 86 and variable speed drive 83B can be utilized to reduce the speed and/or operating time of variable speed vacuum pump 83 to only that level needed to maintain the vacuum level at collection station 80 in this lower range. Sensors 70, control system 86, and variable speed drive 83B can be utilized to continually monitor the vacuum level at the ends of conduits 20 and to lower the vacuum level range at collection station 80 (as well as the operating speed and/or time of variable speed vacuum pump 83) as low as possible while still maintaining a vacuum level of at least 12 inches of mercury at the ends of conduits 20. Operating variable speed vacuum pump 83 at lower speeds and/or for less time reduces the energy consumption of vacuum sewage systems 10 according to the present invention as compared to prior art systems that utilize single speed vacuum pumps.

Thus, vacuum sewage systems 10 and methods of the present invention permit continual monitoring and adjustment of the system operating parameters so that both the vacuum level and vacuum level range at the collection station can be adjusted so as to reduce the speed and/or operating time of variable speed vacuum pump 83 while maintaining the desired vacuum level in vacuum sewage system 10. These adjustments to speed and operating time of variable speed vacuum pump 83 reduce energy consumption as compared to certain prior art systems that utilize single speed vacuum pumps. Furthermore, use of variable speed vacuum pump 83 can reduce energy consumption even if the operating time is maintained or increased as compared to certain prior art systems that utilize a single speed vacuum pump. This is because operating a variable speed vacuum pump of a particular horse power rating at less than maximum speed for a set period of time consumes less energy than operating a single speed vacuum pump having the same horse power rating for the same period of time.

Although the present invention has been shown and described in detail the same is to be taken by way of example only and not by way of limitation. Numerous changes can be made to the embodiments described without departing from the scope of the invention.

What is claimed is:

1. A method of operating a vacuum sewage system including the steps of:

specifying a vacuum level operating range at a collection station, the vacuum level operating range at the collection station having a lower end;

specifying a vacuum level at a location in the system;

detecting the vacuum level at the collection station;

utilizing a sensor to detect the vacuum level at the location in the system;

comparing the vacuum level detected at the location in the system with the specified vacuum level for the location; and if the vacuum level detected at the location in the system is equal to or greater than the specified vacuum level for the location and the vacuum level detected at the collection station is within the specified vacuum level operating range for the collection station, reducing the vacuum level operating range for the collection station.

2. The method of claim 1, further including the steps of:

detecting the vacuum level at the collection station after reducing the vacuum level operating range for the collection station;

detecting the vacuum level at the location in the system after reducing the vacuum level operating range for the collection station;

comparing the vacuum level detected at the location in the system after the vacuum level operating range for the collection station has been reduced with the specified vacuum level for the location; and if the vacuum level detected at the location in the system after the vacuum level operating range for the collection station has been reduced is equal to or greater than the specified vacuum level for the location and the vacuum level detected at the collection station after the vacuum level operating range for the collection station has been reduced is within the reduced vacuum level operating range for the collection station, further reducing the vacuum level operating range for the collection station.

3. The method according to claim 1, wherein the specified vacuum level at a location in the system is 12 inches of mercury gauge value.

4. The method according to claim 1, wherein the specified vacuum level operating range at the collection station is 18 to 20 inches of mercury gauge value.

5. The method according to claim 1, wherein the specified vacuum level operating range at the collection station is 16 to 18 inches of mercury gauge value.

6. The method according to claim 1, wherein the vacuum sewage system includes a conduit having a first end and a second end located farther from the collection station than the first end and the sensor detects the vacuum level at the second end of the conduit.

7. The method according to claim 1, wherein the step of reducing the vacuum level operating range of the collection station includes setting a reduced vacuum level operating range for the collection station having a lower end below the lower end of the specified vacuum level operating range for the collection station.

8. The method according to claim 1, wherein the vacuum sewage system includes a variable speed vacuum pump and further including the step of reducing the speed of the variable speed vacuum pump after reducing the vacuum level operating range for the collection station.

9. The method according to claim 1, wherein the vacuum sewage system includes a variable speed vacuum pump and further including the step of reducing the operating time of the variable speed vacuum pump after reducing the vacuum level operating range for the collection station.

10. The method according to claim 1, wherein the specified vacuum level operating range at the collection station is 18 to 20 inches of mercury gauge value.

11. The method according to claim 10, wherein the first new specified vacuum level operating range at the collection station is 16 to 18 inches of mercury gauge value.

12. A method of operating a vacuum sewage system including the steps of:

specifying a vacuum level operating range at a collection station;

specifying a vacuum level at a location in the system;

detecting the vacuum level at the collection station;

utilizing a sensor to detect the vacuum level at the location in the system;

comparing the vacuum level detected at the location in the system with the previously specified vacuum level for the location; and if the vacuum level detected at the location in the system is equal to or greater than the specified vacuum level for the location and the vacuum level detected at the collection station is within the specified vacuum level operating range for the collection station, specifying a first new vacuum level operating range for the collection station equal in magnitude to the specified vacuum level operating range for the collection station and having a lower upper limit.

13. The method of claim 12, further including the steps of:

detecting the vacuum level at the collection station after specifying the first new vacuum level operating range for the collection station;

detecting the vacuum level at the location in the system after specifying the first new vacuum level operating range for the collection station;

comparing the vacuum level detected at the location in the system after the vacuum level operating range for the collection station has been reduced with the specified vacuum level for the location; and if the vacuum level detected at the location in the system after the vacuum level operating range for the collection station has been reduced is equal to or greater than the specified vacuum level for the location and the vacuum level detected at the collection station after the vacuum level operating range for the collection station has been reduced is within the first new vacuum level operating range for the collection station, specifying a second new vacuum level operating range for the collection station equal in magnitude to the specified vacuum level operating range for the collection station and having a lower upper limit than the first new specified vacuum level operating range for the collection station.

14. The method according to claim 12, wherein the specified vacuum level at a location in the system is 12 inches of mercury gauge value.

15. The method according to claim 12, wherein the vacuum sewage system includes a conduit having a first end and a second end located farther from the collection station than the first end and the sensor detects the vacuum level at the second end of the conduit.

16. The method according to claim 12, wherein the vacuum sewage system includes a variable speed vacuum pump and further including the step of reducing the speed of the variable speed vacuum pump after specifying the new vacuum level operating range for the collection station.

17. The method according to claim 12, wherein the vacuum sewage system includes a variable speed vacuum pump and further including the step of reducing the operating time of the variable speed vacuum pump after specifying the first new vacuum level operating range for the collection station.

* * * * *